US009245721B2

(12) United States Patent
Futterer et al.

(10) Patent No.: US 9,245,721 B2
(45) Date of Patent: Jan. 26, 2016

(54) HIGH-THROUGHPUT MASS-SPECTROMETRIC CHARACTERIZATION OF SAMPLES

(71) Applicant: Bruker Daltonik GmbH, Bremen (DE)

(72) Inventors: Arne Futterer, Bremen (DE); Claus Schafer, Copenhagen (DK); Detlev Suckau, Grasberg (DE)

( * ) Notice: Subject to any disclaimer, the term of this patent is extended or adjusted under 35 U.S.C. 154(b) by 0 days.

(21) Appl. No.: 14/246,792

(22) Filed: Apr. 7, 2014

(65) Prior Publication Data

US 2014/0306104 A1 Oct. 16, 2014

(30) Foreign Application Priority Data

Apr. 10, 2013 (DE) ..... 10 2013 006 132

(51) Int. Cl.
*H01J 49/00* (2006.01)
*H01J 49/26* (2006.01)
*H01J 49/04* (2006.01)

(52) U.S. Cl.
CPC ..... *H01J 49/0095* (2013.01); *H01J 49/0418* (2013.01); *H01J 49/26* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 7,109,481 | B1 | 9/2006 | Zanon et al. | |
| 2004/0217276 | A1 | 11/2004 | DiCesare | |
| 2004/0217278 | A1 | 11/2004 | Overney et al. | |
| 2007/0051899 | A1 * | 3/2007 | Truche et al. | 250/423 P |
| 2007/0158549 | A1 * | 7/2007 | Naya et al. | 250/288 |
| 2009/0101810 | A1 * | 4/2009 | McLean et al. | 250/282 |

FOREIGN PATENT DOCUMENTS

| | | | |
|---|---|---|---|
| EP | 0991930 | B1 | 4/2000 |
| WO | 0135009 | A1 | 5/2001 |
| WO | 2011144743 | A1 | 11/2011 |

* cited by examiner

*Primary Examiner* — Nicole Ippolito
*Assistant Examiner* — Hanway Chang
(74) *Attorney, Agent, or Firm* — Benoit & Cote, Inc.

(57) ABSTRACT

The invention relates to the characterization of samples which are located in their many hundreds up to tens or hundreds of thousands on a sample support plate in a regular pattern, a so-called array, by ionization with matrix-assisted laser desorption and mass spectrometric measurement, for example. The invention proposes that the position of the sample pattern, and thus the position of each sample in the measuring instrument, for example a mass spectrometer, should be determined by measuring at least two finely structured internal position recognition patterns, such as fine crosses. The position recognition patterns are preferably applied as the samples are generated, with the same apparatus which also generates the sample pattern. A mass spectrometer in which laser spots with diameters of only four to five micrometers can be generated, which can preferably be positioned with an accuracy of one micrometer or better, is particularly suitable for the characterization.

12 Claims, 2 Drawing Sheets

HIGH-THROUGHPUT MASS-SPECTROMETRIC CHARACTERIZATION OF SAMPLES

BACKGROUND OF THE INVENTION

1. Field of the Invention

The invention relates to the characterization of samples which are present in many hundreds to tens of thousands on a sample support plate precisely positioned in a regular array, by measurements such as mass spectrum acquisitions with ionization by matrix-assisted laser desorption (MALDI) with a narrowly focused laser beam in a mass spectrometer, for example.

2. Description of the Related Art

Combinatorial chemistry methods with thousands of synthesized samples are currently experiencing a revival, especially for investigating reactions of biopolymer samples with antibodies, with synthesizing or degrading enzymes, or with oxidizing or reducing chemicals. For example, photochemical methods can be used to assemble 100,000 different peptides, which cover the amino acid sequences of all human proteins, strongly adhering on sample supports the size of microscopy specimen slides. These peptides can then, for example, be subjected together to reactions with a specially selected phosphorylase in order to see at which locations in the whole sequence of the human proteome this enzyme exerts its effect. Alternatively, it is possible to bring such peptide arrays into contact with serum or plasma, for example, in order to determine the peptides to which blood constituents bind specifically. The findings thus obtained could be used to screen for auto-antibodies, for example.

Experiments of this type can provide researchers in biochemistry, and in pharmaceutics in particular, with a lot of valuable information. But these experiments require an analytical method that can, at the least, unequivocally indicate which samples on the sample support have reactively changed. Even more advantageous is an analytical method which can indicate the type and position of the reactive change within the sample molecules.

Microscopy can only be used to a limited extent, for example if reactions are accompanied by changes in color or fluorescence. Surface plasmon resonance (SPR) methods, especially imaging SPR, can be used, but have limitations in respect of the sample size. It is also possible to use completely different methods, such as micro-Raman, infrared or UV spectrometry, to determine special types of reaction.

The most advantageous method for high-throughput characterization of samples is provided by mass spectrometry, however. J. H. Lee et al. have already shown that they were able to correctly analyze 5,000 samples on a specimen slide with a coated area of 23 mm by 54 mm (High-Throughput Small Molecule Identification Using MALDI-TOF and a Nanolayered Substrate; Analytical Chemistry, 2011, pubs.acs.org/ac). The authors developed a method which they used to produce sample areas with a diameter of 300 micrometers (with 500-micrometer grid spacing in a square array) each individually coated with a matrix. The position of the array in the mass spectrometer was determined by means of the integrated camera and, as a safeguard, with the aid of 36 equally sized sample spots containing reference substances within the array.

This method reaches its limits if the density of the samples is to be increased significantly. Particularly when the samples are synthesized on the sample support in monoatomic layers, it is no longer possible to recognize them by visual means. In addition, at least for ionization by matrix-assisted laser desorption, matrix substance must be added to the samples afterwards, and homogeneous overcoating can hardly be avoided. The video camera installed in the mass spectrometers can therefore no longer be used to determine the position of the sample array; the positions of the samples must be determined by other means. This applies not only to mass-spectrometric measurement, but also to other types of measurement method.

In view of the foregoing, there is a need to provide instruments and methods with which the position and orientation of a sample array, which cannot be recognized by visual means, on a sample support whose position in an analytical instrument is not known with sufficient accuracy, can be precisely determined to within a few micrometers in order that every sample area can be utilized as completely as possible for characterization of the samples, and particularly for mass-spectrometric characterization with a small-area scan.

SUMMARY OF THE INVENTION

The invention relates to the characterization of samples which are located in their many hundreds (two hundred or more) up to tens or hundreds of thousands on a sample support plate in a regular pattern, a so-called array, by ionization with matrix-assisted laser desorption and mass spectrometric measurement, for example. The sample positions often cannot be recognized by visual means because they are coated with matrix substance. For complete utilization of the tiny samples, which can have diameters of between 10 and 50 micrometers, the position of each sample in the mass spectrometer must, however, be known, ideally to within around one to two micrometers or better, so that high utilization of the sample can be achieved by scanning each individual sample with a fine laser spot or pattern of laser spots. Owing to the mechanical tolerances in the sample support holders, the position of the sample pattern often cannot be reproduced with sufficient accuracy when the sample supports are changed. The invention proposes that the position of the sample pattern, and thus the position of each sample in the measuring instrument, for example a mass spectrometer, should be determined by measuring at least two finely structured internal position recognition patterns, such as fine crosses. The position recognition patterns are preferably applied as the samples are being generated, with the same apparatus which also generates the sample pattern. A mass spectrometer in which laser spots with diameters of only four to five micrometers can be generated, which can preferably be positioned with an accuracy of one micrometer or better, is particularly suitable for the characterization.

For high sample densities up to hundreds of thousands of samples with diameters down to ten micrometers, it is very laborious, if not impossible, to develop structures in which, as described by J. H. Lee et al., the samples are individually prepared in such a way that they can be recognized by a camera, for example by means of recognizable spaces between the samples, and thus indicate the position of the sample array in the ion source of the mass spectrometer via the optical camera image. With "self-assembled monolayers" (SAM) in particular, the monomolecular layers of the samples cannot be recognized by visual means, and each homogeneous preparation also leaves behind an invisible array of samples. After the sample support has been removed from the sample generation apparatus and transferred into an analytical instrument (often through vacuum locks), the mechanical tolerances of the sample support holders mean that the position of the samples on the sample array is known only to within a few tenths of a millimeter.

With high sample densities and small, invisible sample areas, these inaccuracies in the positioning of the sample supports in both the apparatus which produces the sample array (pipetting robot, piezo dispenser, photolithographic peptide synthesizer) as well as in the analytical instrument, for example in the ion source of the mass spectrometer, prevent the individual sample positions from being found with certainty and the more prevent the sample area from being utilized completely, by scanning with a MALDI laser, for example.

To solve this problem, the invention proposes that at least two, preferably three (or more) internal position reference patterns, made of a material which is similar to the sample material, should be added to the field containing the sample array in the apparatus which produces the samples. It shall be possible to measure the internal position reference patterns with high sensitivity in the analytical instrument, and with high positional accuracy, in a similar way to the samples, and these patterns should be several times larger than the positioning inaccuracy, i.e., around 0.5 to 5 millimeters, preferably 1 to 2 millimeters. The form of the reference patterns shall allow them to be easily found and measured, for example with the aid of both a horizontal and a vertical line of a measuring grid or by means of a two-dimensional scan, for example.

The position reference patterns can have the form of crosses comprising two fine, linear sample applications around two millimeters long and with a line thickness of 2 to 20 micrometers. The position of the cross can be determined to within two micrometers by a laser spot measuring only five micrometers in diameter with the aid of one or more horizontal and vertical grid lines. Measuring a second cross gives the position and rotation of the sample pattern, while measuring a third cross reveals a possible distortion of the array into a parallelogram. More complex reference patterns, such as concentric squares or multiple lines can further increase the accuracy of position detection.

DETAILED DESCRIPTION

Figure 1:
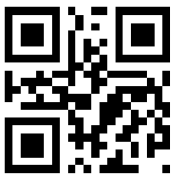
FIG. 1 depicts a conventional QR code (quick response code).

While the invention has been shown and described with reference to a number of embodiments thereof, it will be recognized by those skilled in the art that various changes in form and detail may be made herein without departing from the spirit and scope of the invention as defined by the appended claims.

The mechanical tolerances in the holders of the sample supports mean that the position of the sample pattern cannot be reproduced with sufficient accuracy when the sample supports are moved from the laboratory robot, which produces and applies the samples onto the array, to the characterizing measuring instrument. With many preparation methods it is not possible to recognize the sample positions by visual means. But for complete utilization of the sometimes tiny samples, which may have minute diameters of between 10 and 50 micrometers only, it is necessary that the positions of all the samples in the measuring instrument are known, ideally to within around one to two micrometers. The invention proposes that the position and orientation of the sample array, and thus the position of each sample, is determined in the measuring instrument by measuring at least two finely structured internal recognition patterns made of easily detectable sample material. These may have the form of fine crosses, for example. The recognition patterns are preferably applied as the samples are being generated, with the same apparatus that also generates the sample array. For a mass-spectrometric characterization, which is mainly dealt with here, the mass spectrometer used should, where possible, be one in which ionizing beams or laser spots with diameters of a few micrometers can be produced and accurately positioned, preferably to within one micrometer.

Today it is technically possible to bind sulfurous compounds, such as thiols, thio-ethers and others, onto gold-coated glass surfaces to form monomolecular layers of molecules in a self-structuring way via a sulfur/gold interaction. These molecules can carry reaction centers to which it is possible to covalently bond further molecules photochemically by targeted laser irradiation. The laser irradiation here can be directed onto defined, small areas so that the further molecules are bonded to the molecules only in the irradiated areas. If the covalently bonded molecules are in a suitable configuration, it is possible to again covalently bond any other molecules to these molecules by photochemical means. It is thus possible to produce, for instance, sample arrays which contain 100,000 small sample areas, each coated with different peptides of the same length—20 amino acids each, for example—on one specimen slide. The peptides may represent, for example, all peptide chains of corresponding length of the human proteome, and they even can show overlapping sequences.

In principle, such an array can be used in two different ways: as a modification array and as an interaction array. The peptides can be specifically made to react with reactants, such as enzymes or chemicals, for example, resulting in a so-called modification array, or ligands can be caused to bind to them, forming an interaction array, in order to determine which reactants react with which peptide sequences at which positions, or which ligands bind to which peptide chains.

The methods used to prepare and measure the modifications or the interactions depend greatly on the analytical method used. For the further description it is assumed that the analytical method is a mass-spectrometric one.

Regarding the modification array, all analyte molecules of the samples are reversibly bonded to the surface by covalent, ionic or other non-covalent bonds. After they have been produced, the analyte molecules of the samples are together exposed to test solutions with chemical, particularly enzymatic, activity ("reactants") which can potentially modify the structure of the analyte molecules. In order to measure the structural changes, first the bonds between the sample support surface and the analyte molecules (or between the monomolecular base coating and the analyte molecules) are broken, for example by acidic or alkaline reaction with TFA or $NH_3$, by enzymatic splitting, or by photochemical dissociation. A solvent-free splitting by reactive gases such as $NH_3$ or TFA or photochemistry is to be preferred here because the analyte molecules detached from the array can thus be prevented from diffusing, and the spatial resolution which can be achieved will therefore be as high as possible. Afterwards, the samples are prepared for ionization. If ionization is to be brought about by matrix-assisted laser desorption (MALDI), a matrix substance is applied for this purpose. For high array densities, a full-coverage matrix deposition method such as a spray or a resublimation method is selected, since the individual array positions cannot be individually covered with any precision by the matrix solution. This is a further reason why the individual array positions are no longer visible in the typical way in the optical camera of the ion source of the mass spectrometer. The free analyte molecules can be measured with spatial resolution after this sample preparation.

Regarding the interaction array, all analyte molecules are irreversibly bonded to the surface by covalent, ionic or other non-covalent bonds. The addition of test solutions with potential bonding partners ("ligands") has the effect that the ligands bind reversibly and specifically to the analyte molecules of some of the samples located in the array. The ligands can be antibodies, other binding proteins, glycans, DNA or haptenes, for example. After rinsing to remove all non-specifically bonded test molecules, the array is coated with a MALDI matrix, and only the ligands are specifically detected by mass spectrometry.

In the case of this interaction array, the reference labels for the positional analysis are preferably designed in such a way that known ligands exist for the reference substances which are similar in nature to the ligands expected in the array-based test. The ligands for the reference labels here can either exist naturally in the test solutions or be added specifically in order to carry out the positional analysis.

The sample supports, for example glass specimen slides for microscopy, are fixed in a sample holder within the apparatus which generates the samples. This process creates mechanical positional inaccuracies. Introducing the sample supports into the vacuum system of a mass spectrometer adds further positional uncertainties, and these mechanical tolerances mean that the positions of the sample arrays within the mass spectrometer are known only to within a few tenths of a millimeter.

Modern MALDI time-of-flight mass spectrometers are equipped with cameras which provide a greatly enlarged image of the sample surface and display it on a screen as long as the samples provide a strong enough visual contrast—this is not the case with many sample arrays, however. If it were possible to coat each sample individually with a homogeneous layer of matrix material, the coating of MALDI matrix substance could be used as an indication of the sample position. However, for high sample densities of 50,000 to 100,000 samples and more, and diameters of 10 to 50 micrometers, it is no longer possible to develop coating methods which can be used to coat the samples with matrix substance individually, uniformly and homogeneously. Since the methods for applying the matrix substance should coat every sample area as homogeneously as possible, it is impossible to prevent the spaces in between from also being homogeneously coated. This means that the samples remain invisible and they cannot be localized via the camera in the ion source. Instead, the sample positions have to be determined in a different way, mass-spectrometrically, for example.

The fundamental idea of the method is that not only the sample substances are applied to the sample support in the apparatus producing the sample array, but also patterns of reference substances for determining the position of the array of sample substances. The reference substance must be chosen so that it can be measured with high sensitivity and high positional accuracy. This makes it possible to first measure the reference patterns in the analytical apparatus used, a MALDI-TOF mass spectrometer, for example, under identical preparation and measuring conditions, and to thus carry out a positional calibration. The reference patterns have therefore to be precisely localizable "internal positioning standards", which solve the problems associated with the external positioning inaccuracies between production and analysis of a sample array.

Figure 2:
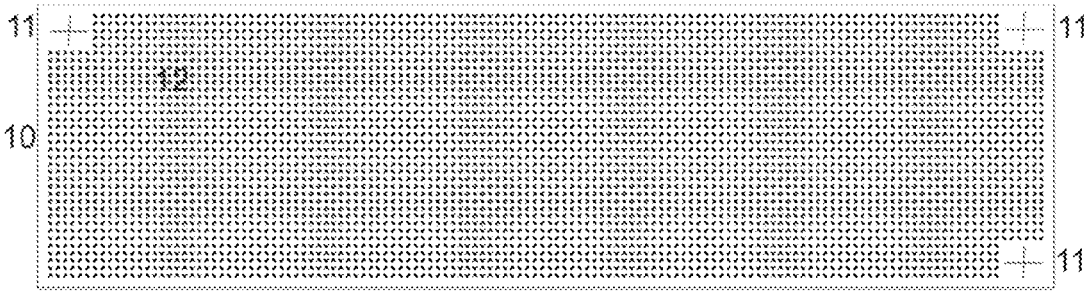
FIG. 2 shows a specimen slide (10) with a sample array (12) and three position recognition patterns (11) in the form of simple crosses. In this example, the position recognition patterns (11) are located near to the edges of the support plate (10). However, a central arrangement of at least some of the patterns (11), surrounded by the array (12), would also be conceivable.

It is therefore proposed that, in the apparatus which produces the samples, at least two, but preferably three (or more), internal reference patterns which are suitable for the position determination should be applied inside or outside the sample array. FIG. 2 shows a specimen slide (10) with sample array (12) and three recognition patterns (11). The latter preferably belong to the same substance class as the analyte samples, because they can then be generated in a single array writing step. They shall preferably consist of a substance which can be easily detected or which can be converted into an easily detectable substance. The internal reference patterns shall be of such a size and shape that they can easily be found and measured, for example with the aid of one horizontal and one vertical line of a measuring grid, said lines being longer than the positional inaccuracy, or by a two-dimensional scan of a pattern which can be used as a whole to determine the position of the reference area.

Figure 3:
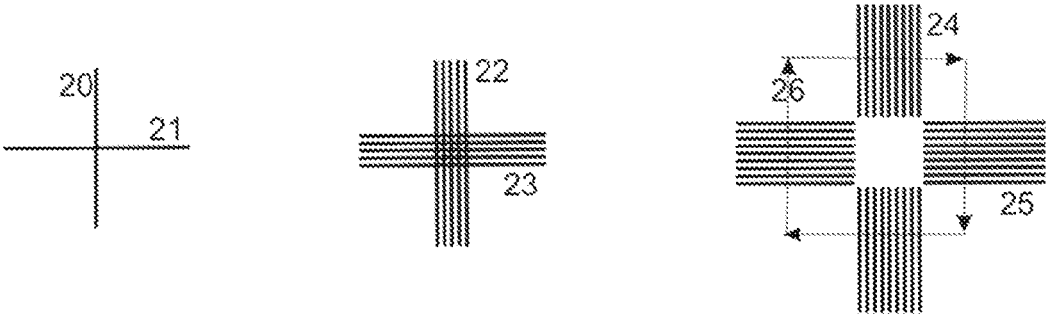
FIG. 3 shows a schematic representation of three recognition patterns: a simple cross made from two sample lines (20) and (21); a cross with two sets of five adjacent sample lines (22) and (23); and a cross with two sets of nine sample lines (24) and (25), showing the track (26) along which the measurements may take place.

As can be seen in FIGS. 2 and 3, the reference patterns can be crosses made from two or more fine, crossed, linear sample applications of around two to ten micrometer line thickness and 300 to 3,000 micrometers long, preferably around five micrometers wide and one to two millimeters long. In FIG. 3, left-hand side, the recognition pattern is a simple cross made from lines (20) and (21); the cross in the center consists of two sets of five parallel lines (22) and (23), and the cross on the right two sets of nine lines (24) and (25). The position of the cross can be determined to within one micrometer by a laser spot around five micrometers in diameter with the aid of horizontal and vertical grid lines (26) if certain precautionary measures are adhered to. Measuring a second cross with its defined position in the array gives the position and rotation of the sample array, while measuring a third cross reveals a possible distortion of the array into a parallelogram. A fourth cross could even determine perspective distortions, as can occur with photolithographic synthesis methods.

Figure 4:
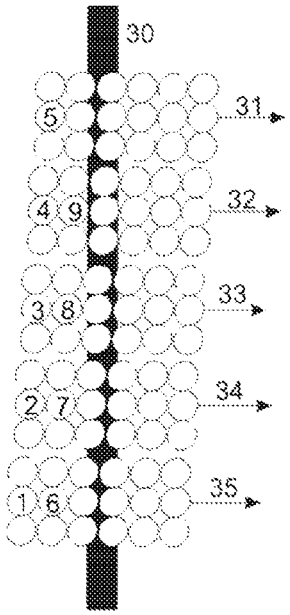
FIG. 4 illustrates the scanning of a sample line (30) which is five micrometers wide in a scanning direction (31 to 35) perpendicular to the sample line. Laser spots with a diameter of five micrometers are each shifted by one micrometer in the forward direction, and offset sidewise in order to measure new sample material without overlapping with exhausted areas. The laser spots here form laterally offset groups (1, 2, 3 . . . ), each comprising three tracks. Each group (1, 2, 3 . . . ) results in one individual sum spectrum, which is obtained by summing several individual scans.

The laser spot should always be moved forward by around one micrometer for the measurement, but this leads to the next laser spot hitting a sample area that is already partially used up, which means that the true increase in the measured intensities is no longer found in successive laser spots. In order to prevent this distortion of the results caused by the sample being used up when laser spots overlap, successive laser spots must be laterally offset, as shown in FIG. 4, to such an extent that they no longer overlap and the laser spot encounters fresh sample material each time. The positional accuracy that can be achieved in this way is much better than the thickness of the reference line or the diameter of the laser spot.

As with all MALDI analyses, the usual procedure is to acquire several mass spectra per measurement spot, wherever possible, and to sum the mass spectra into a sum spectrum in order to improve the signal-to-noise ratio. If the sample is thus exhausted, which can be the case after only two to three laser shots on the same position, then here also it is preferable to use one or more laterally displaced sample spots which have fresh sample material for each sum spectrum. FIG. 4 shows this scanning method with groups consisting of three laser spots for each sum spectrum, and a scan progression of one micrometer at a time. The scanning width in this case is around 75 micrometers, and therefore still results in a thin grid line. If each grid spot is irradiated three times by a laser spot, nine individual spectra are available for each sum spectrum.

More complex reference pattern figures can increase the accuracy of position detection still further. For example, each cross can consist of several fine lines, such as the two sets of nine sample lines crossing each other as shown in FIG. 3 on the right-hand side, where the lines are five micrometers wide and the spacing is likewise five micrometers. It is then possible for measurement to proceed in the form of a small square (26) with an edge length of around one millimeter around the assumed (here uncoated) center of the cross, which is usually known to within around 0.3 millimeters. The evaluation of the mass signals, whose intensities roughly follow a sinusoidal curve, then enables the position of the cross to be detected with an accuracy of better than one micrometer.

The reference patterns for the position detection can also have a similar form to the reference patterns of the QR codes (FIG. 1), which are known for optical applications from the prior art (FIG. 1), and can then be scanned either in lines or as a complete area.

For this method it is advantageous to use a mass spectrometer which is equipped with a high laser shot rate, for example a 10 kHz laser and the appropriate electronics for ion guiding and spectral acquisition. Moreover, it is advantageous if not only the sample support is moved for the scanning procedure in the mass spectrometer, but it is also possible to use laser spot guidance. The combination of sample support movement and laser spot guidance makes it possible to scan a square with one millimeter edge length around the assumed center of the cross, which requires a total of 40,000 laser shots when there are ten individual spectra per sum spectrum, in only four seconds. It is thus possible to determine the position of the sample array to within better than one micrometer in only 12 seconds plus the time needed to move the sample support plate from one position reference pattern to the other.

After the precise position of the samples has been determined, it is possible to start their mass-spectrometric characterization, which, as explained above, consists in measuring the modified analyte molecules or the interaction ligands. The precise knowledge of the sample positions means that all sample molecules are available for the analysis in each case. The sample areas can each be scanned to the extent required for the measurement.

The method of ionization by matrix-assisted laser desorption (MALDI) usually shows only the molecular ions. In the case of enzymatic splitting reactions, the site of the split can thus also be detected. With additive reactions, for example a phosphorylation, the method indicates which samples have reacted, but the position of the reaction cannot be identified. In order to also identify the position of the reaction, the analyte molecule ion must be fragmented and a daughter ion spectrum must be acquired. This is very difficult with the very small amounts of sample: the sample must be ionized, fragmented and utilized to an extremely high degree in order to also carry out MS/MS. This may still be possible for slightly larger sample spots measuring around 30 by 30 micrometers square, but only really because the position of the sample is known very precisely.

The method of internal reference patterns can be extended to other imaging methods so that multi-dimensional information can be linked to the mass-spectrometrically analyzed array data. A method of interest is, for example, one where the binding of unknown ligands to an array is first determined kinetically and quantitatively with the aid of SPR imaging (SPRi). This method determines each array position where a ligand has bonded. In an intelligent work flow, the mass-spectrometric analysis of the array can therefore be limited to these positions only, although it is preferable to analyze them with the same positional accuracy. In such a bimodal data set, the molecular weights of the ligands and the characteristic bonding data can then be linked together because the reference points are also visible in the SPR image and determine the position.

Moreover, in the multimodal analysis of the arrays it is also possible to use direct imaging methods such as IR, Raman spectroscopy or SPR to identify deviations of individual array spots from the ideal geometry of the array, and to determine spot-specific correction vectors. Once the positions of the reference spots have been determined, these vectors can even be used to additionally correct spot-specific positional deviations.

The method can be extended by using trypsin or another enzyme to degrade protein ligands which are bonded to array positions to peptides, and identifying them by peptide mass fingerprinting with the aid of MS and MS/MS and a sequence database search. The ligand's molecular mass and the identity of the protein can thus be added to the functional data. Such tryptic peptides of known protein ligands could also be used as reference substances for position detection.

Figure 5:
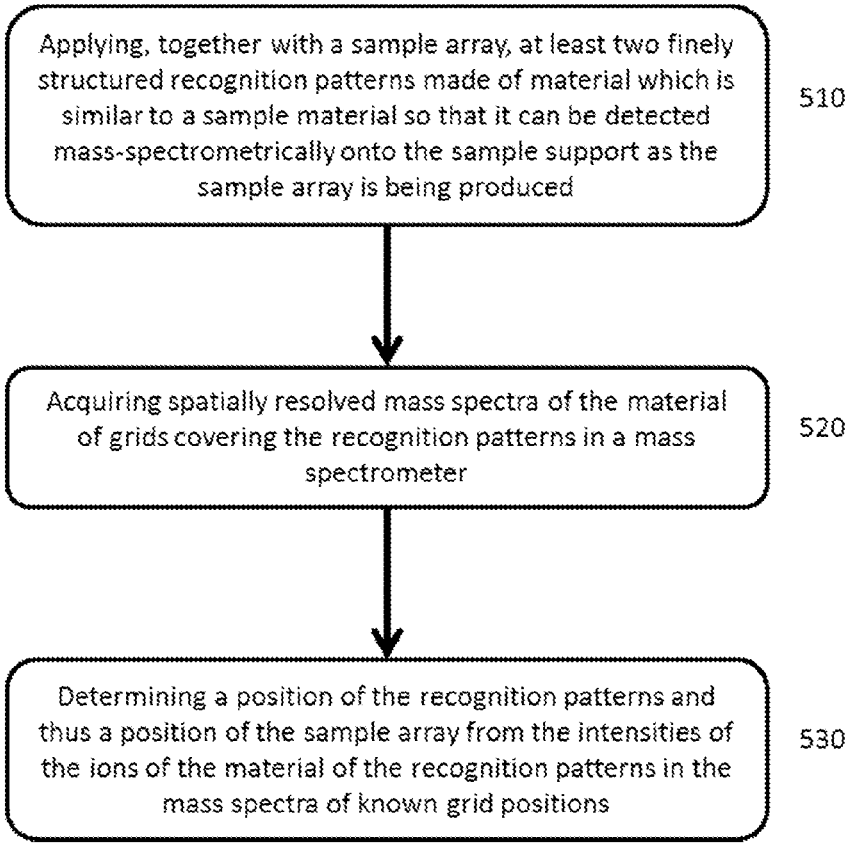
FIG. 5 is a flow chart of a method according to principles of the invention.

FIG. 5 shows a flow chart of a method according to principles of the invention. The first step (510) includes applying, together with a sample array, at least two finely structured recognition patterns made of material which is similar to a sample material so that it can be detected mass-spectrometrically onto the sample support as the sample array is being produced. The second step (520) includes acquiring spatially resolved mass spectra of the material of grids covering the recognition patterns in a mass spectrometer. The third step (530) includes determining a position of the recognition patterns and thus a position of the sample array from the intensities of the ions of the material of the recognition patterns in the mass spectra of known grid positions.

The invention has been described with reference to different embodiments thereof. It will be understood, however, that various aspects or details of the invention may be changed, or that different aspects disclosed in conjunction with different embodiments of the invention may be readily combined if practicable, without departing from the scope of the invention. Furthermore, the foregoing description is for the purpose of illustration only, and not for the purpose of limiting the invention, which is defined solely by the appended claims.

The invention claimed is:

1. A sample support for high-throughput characterization which is designed to hold an array of several hundred up to tens or hundreds of thousands of samples, wherein a sample material is to be characterized with a mass spectrometer, wherein at least two position recognition patterns made of a material which is similar to the sample material and can hence be recognized with an analytical method of the mass spectrometer are prepared on the sample support together with the sample array, and are ionized and analyzed by the mass spectrometer to determine a position and orientation of the array.

2. The sample support according to claim 1, wherein the material for the position recognition patterns is suitable for ionization by matrix-assisted laser desorption.

3. The sample support according to claim 1, wherein the position recognition pattern comprises spots or lines the position of which can be recognized in the mass spectrometer.

4. The sample support according to claim 3, wherein the position recognition pattern comprises several intersecting lines.

5. The sample support according to claim 3, wherein the lines are each around 2 to 20 micrometers wide and around 0.5 to 5 millimeters long.

6. The sample support according to claim 3, wherein the lines consist of a material which can be ionized with a high ion yield.

7. The sample support according to claim 1, wherein the sample material comprises self-assembled monolayers.

8. The sample support according to claim 1, comprising three position recognition patterns, the third recognition pattern allowing for measuring a possible distortion of the array into a parallelogram.

9. The sample support according to claim 1, wherein the position recognition patterns are located one of near to the edges of the support and centrally, surrounded by the array.

10. A method for high-throughput mass-spectrometric characterization of several hundred up to tens to hundreds of thousands of samples which are arranged in an array on a sample support with the steps:

a) applying, together with the sample array, at least two finely structured recognition patterns made of material which is similar to a sample material so that it can be detected mass-spectrometrically onto the sample support as the sample array is being produced, b) acquiring spatially resolved mass spectra of the material of grids covering the recognition patterns in a mass spectrometer, and c) determining a position of the recognition patterns and thus a position of the sample array from the intensities of ions of the material of the recognition patterns in the mass spectra of known grid positions.

11. The method for high-throughput mass-spectrometric characterization according to claim 10, wherein the ions for the acquisition of spatially resolved mass spectra in Step b) are generated using ionization by matrix-assisted laser desorption.

12. The method according to claim 10, wherein the material of the recognition patterns is provided with ligands, and the ligands, or fragments of the ligands originating from enzymatic breakdown, are measured in order to identify the position of the array.

* * * * *